US011841030B2

(12) United States Patent
Yoshino et al.

(10) Patent No.: US 11,841,030 B2
(45) Date of Patent: Dec. 12, 2023

(54) IMPELLER

(71) Applicant: Nidec Corporation, Kyoto (JP)

(72) Inventors: Shingo Yoshino, Kyoto (JP); Naoya Nonomura, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 18/078,130

(22) Filed: Dec. 9, 2022

(65) Prior Publication Data

US 2023/0204044 A1 Jun. 29, 2023

(51) Int. Cl.
*F04D 29/28* (2006.01)
*F04D 29/32* (2006.01)

(52) U.S. Cl.
CPC ..... *F04D 29/327* (2013.01); *F04D 29/282* (2013.01); *F04D 29/326* (2013.01)

(58) Field of Classification Search
CPC .. F04D 29/281; F04D 29/282; F04D 29/2216; F04D 29/242; F04D 29/66
See application file for complete search history.

(56) References Cited

U.S. PATENT DOCUMENTS

| | | | | |
|---|---|---|---|---|
| 9,995,311 | B2 * | 6/2018 | Son | B21D 11/20 |
| 10,465,696 | B2 * | 11/2019 | Kim | F04D 29/30 |
| 10,517,488 | B2 * | 12/2019 | Pekander | A61B 5/308 |
| 11,454,249 | B2 * | 9/2022 | Chen | F24F 7/007 |

FOREIGN PATENT DOCUMENTS

JP 2015-102003 A 6/2015

* cited by examiner

*Primary Examiner* — Sabbir Hasan
(74) *Attorney, Agent, or Firm* — KEATING & BENNETT

(57) ABSTRACT

A centrifugal fan includes an impeller with a base expanded radially, vanes arranged circumferentially, extending from a radially inner side to a radially outer side, and ends thereof at one axial side being connected to the base, and a ring portion connecting ends of the vanes at the other axial side. The vanes include first vanes and second vanes, when viewed axially, the lengths of the second vanes are larger than the lengths of the first vanes, the first vanes and the second vanes are circumferentially arranged alternatingly. Gaps are provided between radially outer ends of the first vanes and the second vanes that are circumferentially adjacent to each other, and sizes of circumferentially adjacent ones of the gaps are different from each other.

11 Claims, 6 Drawing Sheets

IMPELLER

CROSS REFERENCE TO RELATED APPLICATION

The present application claims priority under 35 U.S.C. § 119 to Chinese Application No. 202111614298, filed on Dec. 27, 2021, the entire contents of which are hereby incorporated herein by reference.

1. Field of the Invention

The present disclosure relates to an impeller.

2. Background

A known centrifugal fan rotates around a central axis extending axially, and includes a base expanded radially, a plurality of vanes arranged circumferentially, extending from a radially inner side to a radially outer side, and ends thereof at one axial side being connected to the base, and a ring portion connecting ends of the plurality of vanes at the other axial side (See, for example, Patent application publication No. JP2015-102003A).

In the above mentioned centrifugal fan, the plurality of vanes are of the same length, so the amount of material for manufacturing (for example, resin) is large, thus may result in an increase of cost. On the other hand, if the length of the plurality of vanes is reduced for saving manufacturing material, it may result in deterioration of the performance (for example, reduction of the output blowing rate).

SUMMARY

In view of the above mentioned problem(s), preferred embodiments of the present disclosure provide an impeller which can facilitate reduction of manufacturing material while improving performance.

Preferred embodiments of the present disclosure provide an impeller rotatable about an axially extending central axis, and includes a base expanded radially, vanes arranged circumferentially, extending from a radially inner side to a radially outer side, and ends thereof at one axial side being connected to the base, and a ring portion connecting ends of the vanes at another axial side. The vanes includes first vanes and second vanes, when viewed axially, a length of the second vanes is larger than a length of the first vanes, the first vanes and the second vanes are arranged circumferentially alternatingly, gaps are defined between radially outer ends of the first vanes and the second vanes that are circumferentially adjacent to each other, sizes of circumferentially adjacent ones of the gaps are different from each other.

In an impeller according to a preferred embodiment of the present disclosure, the vanes include first vanes and second vanes, when viewed axially, the length of the second vanes is larger than the length of the first vanes, the first vanes and the second vanes are arranged circumferentially in alternative, so compared to the case that the vanes are only consist of the second vanes, manufacturing materials such as resin can be reduced, and the whole weight of the impeller can be reduced, thus reducing consumption of electricity. Gaps are between radially outer ends of the first vanes and the second vanes that are circumferentially adjacent to each other, and sizes of circumferentially adjacent ones of the gaps are different from each other so static pressure at the portions where gaps between radially outer ends of the first vanes and the second vanes are relative small can be improved.

In an impeller of a preferred embodiment of the present disclosure, it is preferred that when viewing axially, the length of the first vanes is half of the length of the second vanes or above. For example, when viewing axially, the length of the first vanes is about ¾ of the length of the second vanes.

According to an impeller of a preferred embodiment of the present disclosure, the length of the first vanes is about half of the length of the second vanes or more, so it can facilitate in reducing manufacturing material while guaranteeing output blowing rate.

In addition, in an impeller of a preferred embodiment of the present disclosure, it is preferred that in two the gaps at two sides of the first vanes circumferentially, the gap closer to the front of rotation direction of the impeller than the first vanes is a first gap, the gap closer to the rear of rotation direction of the impeller than the first vanes is a second gap, the first gap is smaller than the second gap.

In an impeller according of a preferred embodiment of the present disclosure, in two gaps at two sides of the first vanes circumferentially, the gap closer to the front of rotation direction of the impeller than the first vanes is a first gap, the gap closer to the rear of rotation direction of the impeller than the first vanes is a second gap, the first gap is smaller than the second gap, thus static pressure at the first gap can be increased.

In addition, in an impeller of a preferred embodiment of the present disclosure, it is preferred that the first gap is about half of the second gap or more. For example, the first gap is about ¾ of the second gap.

In an impeller according to a preferred embodiment of the present disclosure, the first gap is about half of the second gap or more, so static pressure at the first gap can be increased.

In addition, in an impeller of preferred embodiments of the present disclosure, it is preferred that inclined portions are provided at axial inner ends of the vanes, the inclined portions incline in such a way that the inclined portions are closer to an axially outer side as the inclined portions are closer to the other axial side.

In an impeller according to a preferred embodiment of the present disclosure, inclined portions are provided at axial inner ends of the vanes, the inclined portions incline in such a way that the inclined portions are closer to an axially outer side as the inclined portions are closer to the other axial side, so when the impeller is provided in a duct, a gap between inlet of the duct and ends of the vanes at the other axial side can be easily guaranteed, thus suppressing noise produced when the impeller rotates.

In an impeller of a preferred embodiment of the present disclosure, it is preferred that the inclined portions include first inclined portions at ends at the other axial side of the first vanes, and second inclined portions at ends at the other axial side of the second vanes.

In an impeller according to a preferred embodiment of the present disclosure, the inclined portions include first inclined portions at ends at the other axial side of the first vanes, and second inclined portions at ends at the other axial side of the second vanes, so when the impeller is provided in a duct, a gap between an inlet of the duct and ends at the other axial side of the vanes can be more easily guaranteed, thus suppressing noise produced when the impeller rotates.

In an impeller of a preferred embodiment of the present disclosure, it is preferred that a bulged portion protruding towards the other axial side is at the center of the base, axial inner ends of the first inclined portions are closer to the one axial side than the bulged portion.

In an impeller according to a preferred embodiment of the present disclosure, a bulged portion protruding towards the other axial side is at the center of the base, axial inner ends of the first inclined portions are closer to the one axial side than the bulged portion, so when the impeller rotates, more air can be sucked in, and when the impeller is provided in a duct, a gap between an inlet of the duct and ends at the other axial side of the first vanes can be more easily guaranteed, thus suppressing noise produced when the impeller rotates.

In an impeller of a preferred embodiment of the present disclosure, it is preferred that a bulged portion protruding towards the other axial side is at the center of the base, axial inner ends of the second inclined portions are closer to the other axial side than the bulged portion.

In the impeller according to a preferred embodiment of the present disclosure, a bulged portion protruding towards the other axial side is at the center of the base, axial inner ends of the second inclined portions are closer to the other axial side than the bulged portion, so when the impeller rotates, more air can be sucked in, and when the impeller is provided in a duct, a gap between an inlet of the duct and ends at the other axial side of the second vanes can be more easily guaranteed, thus suppressing noise produced when the impeller rotates.

In an impeller of a preferred embodiment of the present disclosure, it is preferred that a circumferential thickness of the radially outer ends of the vanes reduces from one axial side to the other axial side.

In an impeller according to a preferred embodiment of the present disclosure, a circumferential thickness of the radially outer ends of the vanes reduces from one axial side to the other axial side, so the manufacturing material such as resin can be further reduced, and the whole weight of the impeller can be further reduced, thus reducing electrical consumption.

In an impeller of a preferred embodiment of the present disclosure, it is preferred that the impeller includes a motor.

In an impeller of a preferred embodiment of the present disclosure, it is preferred that the impeller is an impeller of a fan used for a refrigerator.

According to a preferred embodiment of the present disclosure, the vanes include first vanes and second vanes, when viewed axially, the length of the second vanes is larger than the length of the first vanes, the first vanes and the second vanes are arranged circumferentially alternatingly, so compared to the case that the vanes only include the second vanes, manufacturing materials such as resin can be reduced, and the whole weight of the impeller can be reduced, thus reducing consumption of electricity, and gaps are between radially outer ends of the first vanes and the second vanes that are circumferentially adjacent to each other, sizes of circumferentially adjacent ones of the gaps are different from each other, so static pressure at the portions where gaps between radially outer ends of the first vanes and the second vanes are relatively small can be improved.

The above and other elements, features, steps, characteristics and advantages of the present disclosure will become more apparent from the following detailed description of the example embodiments with reference to the attached drawings.

DETAILED DESCRIPTION

Figure 1:
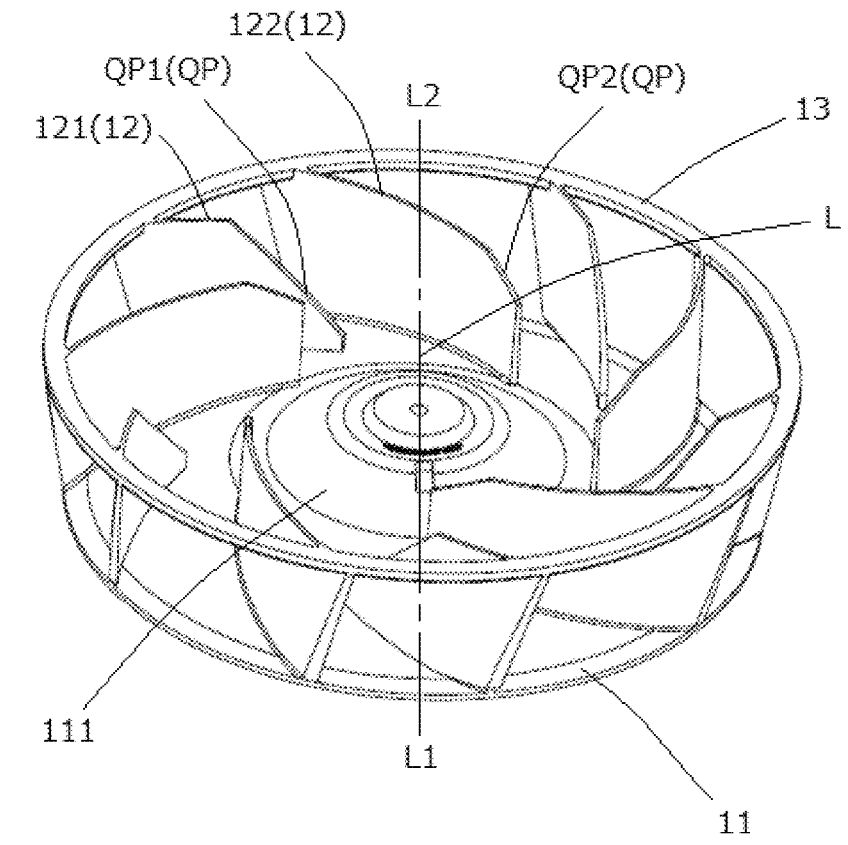
FIG. 1 is a perspective view schematically showing an impeller of an example embodiment of the present disclosure.

Hereinafter, an impeller of an example embodiment of the present disclosure will be illustrated with reference to FIGS. 1-4.

In the description, a direction parallel to a rotation axis L of an impeller 1 is an "axial direction", and an axial side L1 and the other axial side L2 are defined as shown in the drawings. A radial direction orthogonal to the rotation axis L is a "radial direction", the side in radial direction close to the rotation axis L is a "radially inner side", the side in the radial direction away from the rotation axis L is a "radially outer side", and the circumference with the rotation axis L as center is a "circumference".

As shown in FIG. 1, the impeller rotates around a central axis L extending axially, and includes a base 11 expanded radially, a plurality of vanes 12 arranged circumferentially, extending from a radially inner side to a radially outer side, and ends thereof at one axial side L1 are connected to the base 11, and a ring portion 13 connecting ends of the plurality of vanes 12 at the other axial side L2.

Figure 2:
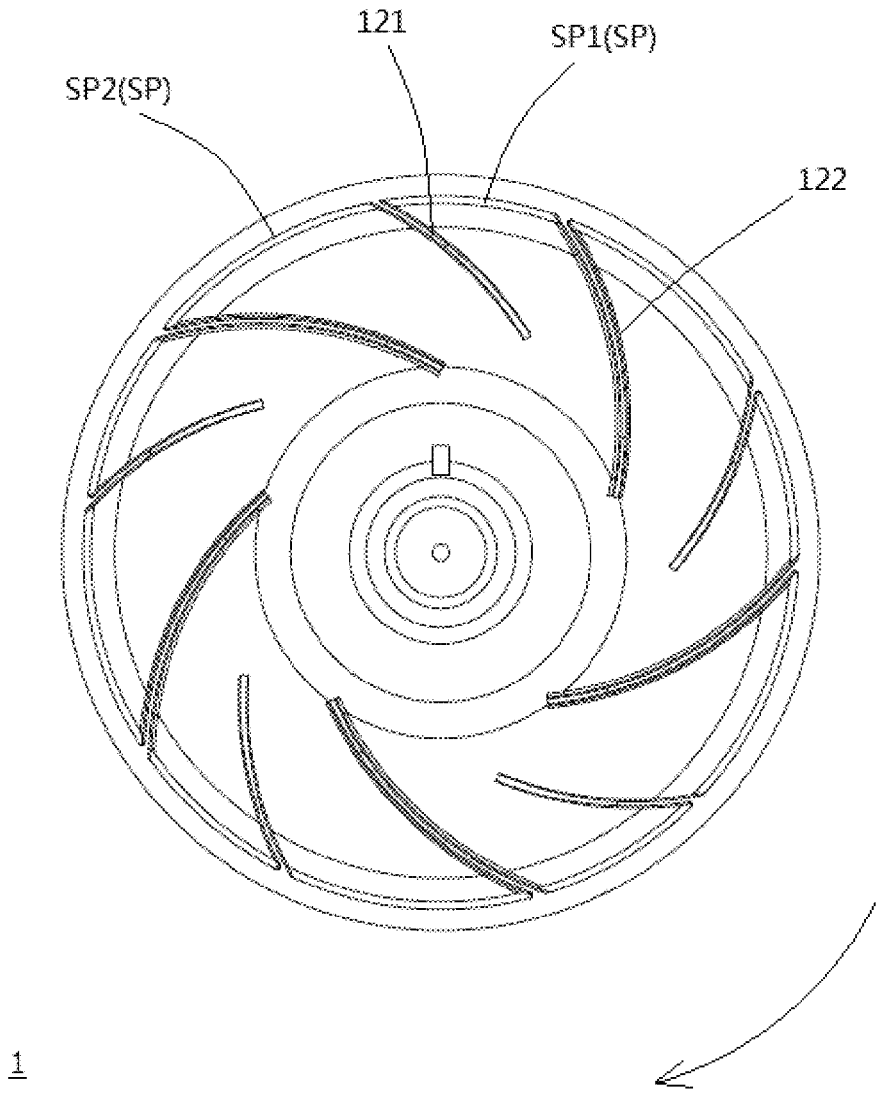
FIG. 2 is a top view schematically showing an impeller of an example embodiment of the present disclosure.
Figure 4:
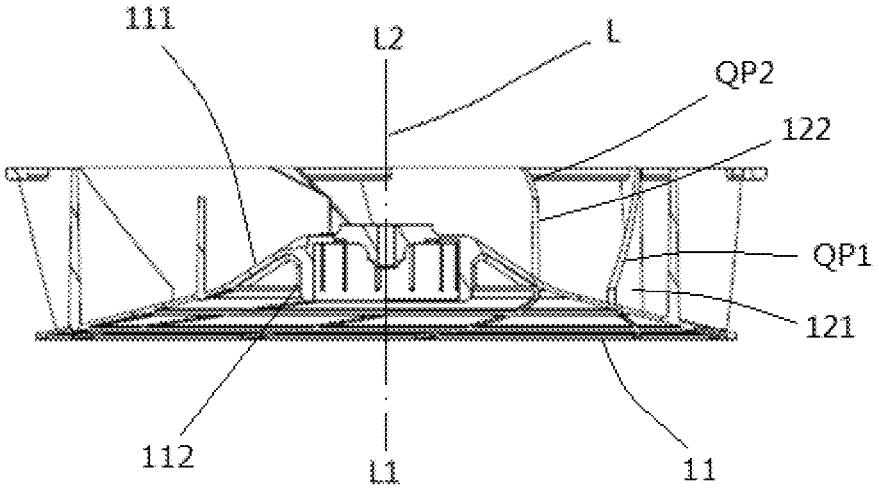
FIG. 4 is a cutaway view obtained by cutting by a plane passing through a central axis that schematically showing an impeller of an example embodiment of the present disclosure.
Figure 5:
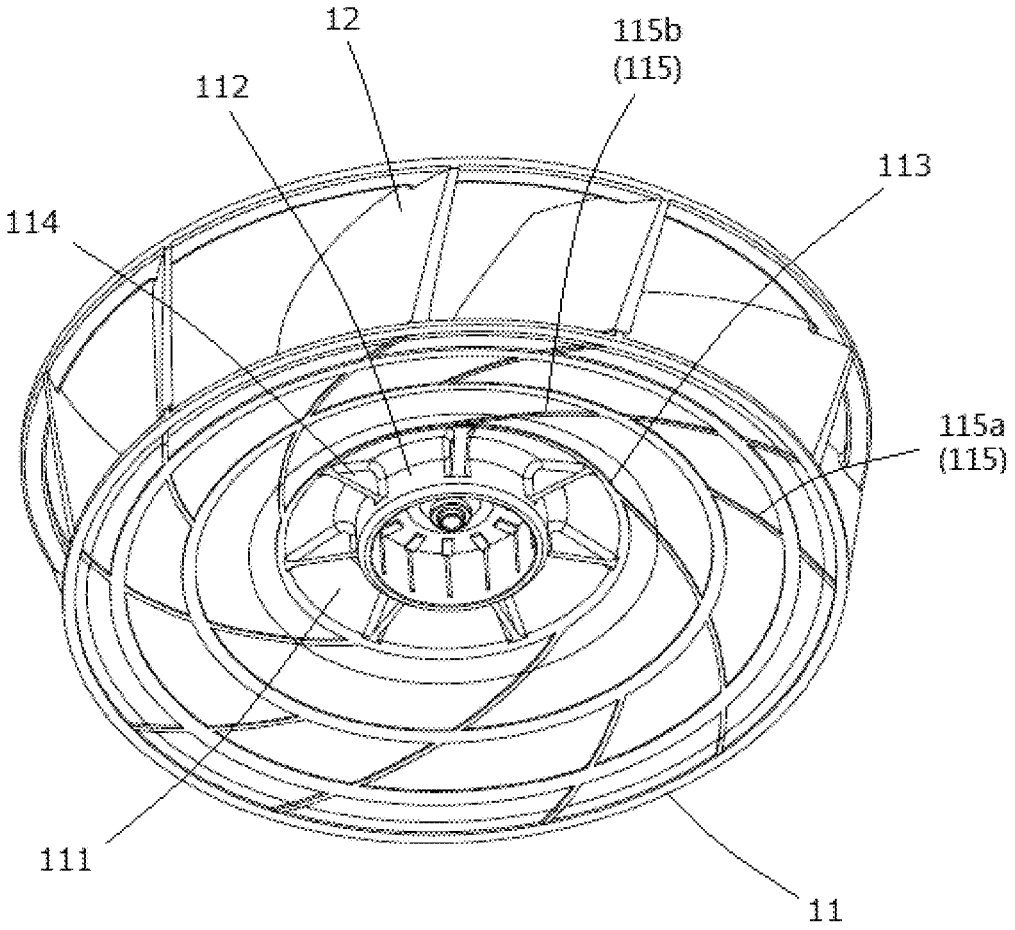
FIG. 5 is a perspective view observed from a side opposite to FIG. 1 that schematically showing an impeller of an example embodiment of the present disclosure.

Here, as shown in FIGS. 1 and 2, the base 11 has a disk shape when viewed axially, the ring portion 13 has an annular shape when viewed axially, an outer diameter of the ring portion 13 is larger than an outer diameter of the base 11. As shown in FIG. 1, a bulged portion 111 projecting towards the other axial side L2 is located at a center of the base 11 (in the example shown in the drawings, the bulged portion 111 extends to outer periphery of the base 11, but it is not limited), a plurality of vanes 12 extend from the bulged portion 111 towards the other axial side L2. As shown in FIGS. 4 and 5, the bulged portion 111 has a cup shape opening towards the one axial side L1, the space defined by the opening of the bulged portion 111 towards the one axial side L1 is used for receiving a motor (not shown), the motor is used to drive the impeller 12 to rotate, for example, having a rotor provided coaxially to the impeller 12 and a stator surrounding the rotor from outside. Specifically, as shown in FIGS. 4 and 5, a through hole extending through axially (for example, for a central shaft of the above-mentioned motor to pass through) is located at the center of the bulged portion 111, a surface of the bulged portion 111 at the one axial side L1 (i.e., a surface of the base 11 at the one axial side L1) is provided with a cylinder portion 112 to receive the motor, the cylinder portion 112 extends from the surface of the bulged portion 111 at the one axial side L1 towards the one axial side L1 in a way that is coaxial to the impeller 12, and end of the cylinder portion 112 at the one axial side L1 is closer to the other axial side L2 than the outer peripheral of the base 11. As shown in FIG. 5, a plurality of annular projections 113 and a plurality of ribs 114 are provided on the surface of the base 11 at the one axial side L1, the plurality of annular projections 113 defines a concentric circular with the rotation axial L as a center, the plurality of ribs 114 extend from outer circumferential surface of the cylinder portion 112 to one annular projection of the plurality of annular projections 113 that is closest to the rotation axis L, and are arranged with equal-angular space around the rotation axis L. As shown in FIG. 5, a plurality of radial projections 115 are further provided on a surface of the base 11 at the one axial side L1 (in the example shown in the drawings, it includes first radial projections 115*a* and second radial projections 115*b* that are arranged circumferentially in alternative), the plurality of radial projections 115 are located at positions overlapping the plurality of vanes 12 respectively when viewed axially, and extend from a radially inner side to a radially outer side.

As shown in FIGS. 1 and 2, the plurality of vanes 12 include first vanes 121 and second vanes 122, when viewed axially, a length of the second vanes 122 is larger than a length of the first vanes 121 (preferably, when viewed axially, the length of the first vanes 121 is about half of the length of the second vanes 122 or more, but it is not limited), the first vanes 121 and the second vanes 122 are arranged circumferentially in alternative, gaps SP are located between radially outer ends of the first vanes 121 and the second vanes 122 that are that are circumferentially adjacent to each other, and sizes of circumferentially adjacent ones of the gaps are different from each other. As shown in FIG. 2, radial inner ends of the first vanes 121 are closer to radially outer side than radial inner ends of the second vanes 122, but radially outer ends of the first vanes 121 and radially outer ends of the second vanes 122 are located on a same circle with the rotation axis L as a center.

As shown in FIG. 2, in the two gaps SP at both sides of the first vanes 121 circumferentially, the gap closer to the front in rotation direction (see the arrow in FIG. 2) than the first vanes 121 is a first gap SP1, the gap closer to the rear in rotation direction (the side opposite to the arrow of FIG. 2) than the first vanes 121 is a second gap SP2, the first gap SP1 is smaller than the second gap SP2 (preferably the first gap SP1 is half of the second gap SP2 or above, but not limited).

As shown in FIG. 1, inclined portions QP are provided at radial inner ends of the vanes 12, the inclined portions QP incline in such a way that it is closer to radially outer side as it is closer to the other axial side L2. Specifically, the inclined portions QP include first inclined portions QP1 and second inclined portions QP2, the first inclined portions QP1 are provided on ends of the first vanes 121 at the other axial side L2, the second inclined portions QP2 are provided on ends of the second vanes 122 at the other axial side L2. As shown in FIGS. 1 and 4, the radial inner ends of the first inclined portions QP1 are closer to the one axial side L1 than the bulged portion 111 (specifically, the end of the bulged portion 111 at the other axial side L2), the radial inner ends of the second inclined portion QP2 are closer to the other axial side L2 than the bulged portion 111 (specifically, the end of the bulged portion 111 at the other axial side L2).

Figure 3:
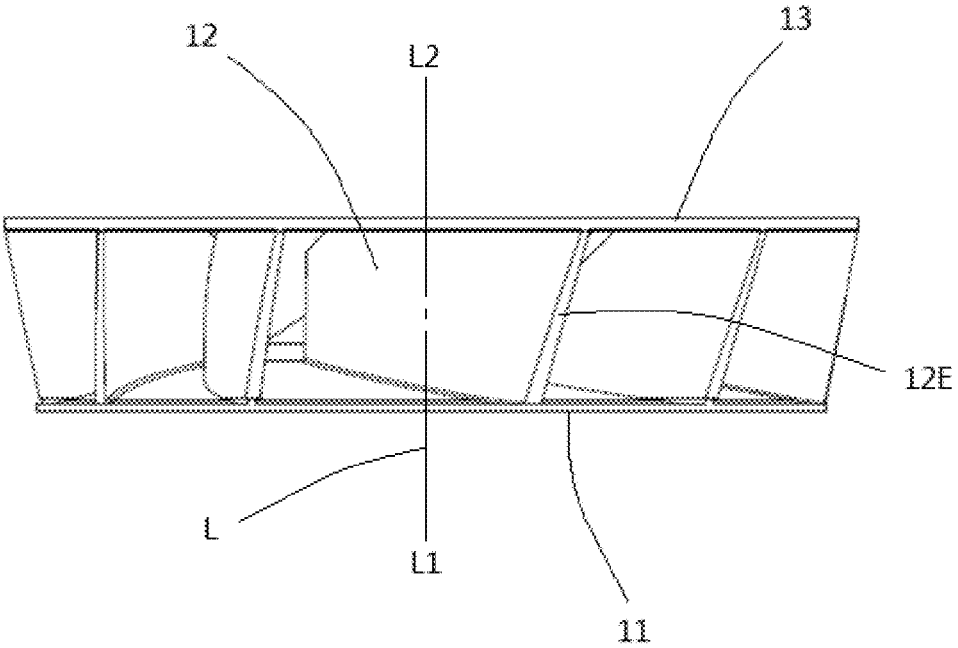
FIG. 3 is a front view schematically showing an impeller of an example embodiment of the present disclosure.

As shown in FIG. 3, a circumferential thickness of radially outer ends 12E of the vanes 12 reduces from the one axial side L1 to the other axial side L2.

In the impeller 1 according to the present example embodiment, the plurality of vanes 12 include first vanes 121 and second vanes 122, when viewed axially, the lengths of the second vanes 122 are larger than the length of the first vanes 121, the first vanes 121 and the second vanes 122 are arranged circumferentially alternatingly, so compared to the case that the vanes 12 only include the second vanes 122, manufacturing materials such as resin can be reduced, and the whole weight of the impeller 1 can be reduced, thus reducing consumption of electricity. Also, gaps SP are provided between radially outer ends of the first vanes 121 and the second vanes 122 that are circumferentially adjacent to each other, sizes of circumferentially adjacent ones of the gaps SP are different from each other, so static pressure at the portions where gaps SP between radially outer ends of the first vanes 121 and the second vanes 122 are relative small can be improved.

The present disclosure is exemplarily illustrated above with reference to the drawings, and realization of the present disclosure is not limited by the example embodiments described above.

Figure 6:
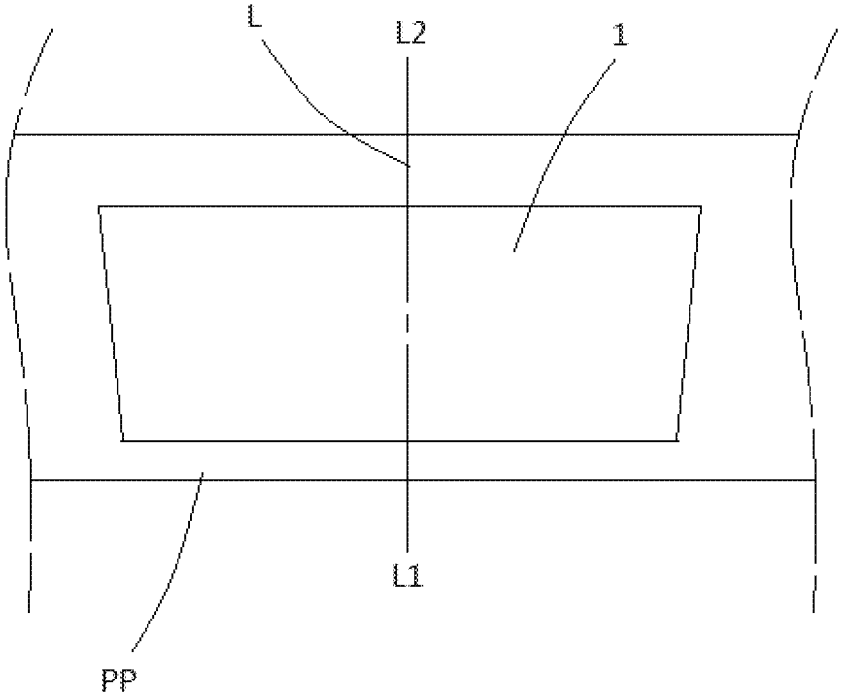
FIG. 6 is a schematic view showing an impeller of an example embodiment of the present disclosure when it is used in a refrigerator.

For example, in the example embodiments described above, the impeller 1 can be used as impeller of fan used in a refrigerator, and the impeller 1 can be provided in a venting duct PP of the refrigerator as, for example, shown in FIG. 6, so that the axial direction of the impeller 1 coincides with the up-down direction, and the one axial side of the impeller 1 is at lower side.

In the example embodiments described above, the first gaps SP1 and the second gaps SP2 located at both sides of the first vanes 121 circumferentially are different from each other, but it is not limited to this, and the first gaps SP1 and the second gaps SP2 can be identical.

In the example embodiments described above, the inclined portions QP include first inclined portions QP1 and second inclined portions QP2 that are different from each other in terms of shape and size, but it is not limited to this, and the first inclined portions QP1 and second inclined portions QP2 can be identical to each other in terms of shape and size.

In the example embodiments described above, the first vanes 121 and the second vanes 122 include inclined portions QP, respectively, but it is not limited to this, and the inclined portions can be provided on one of the first vanes 121 and the second vanes 122, and according to condition, the inclined portions QP can be provided neither on the first vanes 121 nor on the second vanes 122.

In the example embodiments described above, circumferential thicknesses of radially outer ends of the vanes 12 decrease from the one axial side L1 towards the other axial side L2, but it is not limited to this, and the circumferential thicknesses of radially outer ends of the vanes 12 can be constant from the one axial side L1 towards the other axial side L2.

In the example embodiments described above, the specific shape and size of the base 11 and the ring portion 13 can be varied based on requirements.

In the example embodiments described above, the first vanes 121 and the second vanes 122, when viewed axially, extend in arc shape, but it is not limited to this, and the first vanes 121 and the second vanes 122, when viewed axially, extend in straight line.

In the example embodiments described above, the numbers of the first vanes 121 and the second vanes 122 can be varied properly, and are not limited to the numbers shown in the drawings.

In the example embodiments described above, a surface of the base 11 at the one axial side L1 includes a cylinder portion 112, annular projections 113, ribs 114, first radial projections 115*a* and second radial projections 115*b*. Thus, the cylinder portion 112 and the base 11 can be fixedly secured, and the strength of the base 11 can be improved. There may be a plurality of annular projections 113, or just one annular projection 113 may be provided. The first radial projections 115*a* have lengths corresponding to the first vanes 121, and axial positions of the first radial projections 115*a* and the first vanes 121 are at least partially overlapped. The second radial projections 115*b* have lengths corresponding to the second vane 122, and axial positions of the second radial projections 115*b* and the second vanes 122 are at least partially overlapped. Thus, the strength of the base 11 can be improved.

In the example embodiments described above, according to the conditions, one or more (even all) of the cylinder portion 112, the annular projections 113, the ribs 114 and the first radial projections 115*a* can be omitted.

It can be understood that within the scope of the present disclosure, portions or features of the example embodiments can be freely combined, or portions or features of the example embodiments can be varied or omitted.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A centrifugal fan rotatable around a central axis extending axially, the centrifugal fan comprising:

a base expanded radially;

vanes arranged circumferentially, extending from a radially inner side to a radially outer side, and ends thereof at one axial side being connected to the base; and a ring portion connecting ends of the vanes at another axial side; wherein the vanes include:

first vanes; and second vanes, when viewed axially, lengths of the second vanes are larger than a length of the first vanes;

the first vanes and the second vanes are arranged circumferentially alternatingly;

gaps are provided between radially outer ends of the first vanes and the second vanes that are circumferentially adjacent to each other;

sizes of respective ones of the circumferentially adjacent gaps are different from each other.

2. The centrifugal fan in accordance with claim 1, wherein when viewed axially, a length of the first vanes is about half of a length of the second vanes or more.

3. The centrifugal fan in accordance with claim 1, wherein in two of the gaps at two sides of the first vanes circumferentially, the gap closer to a front of a rotation direction of an impeller than the first vanes is a first gap, the gap closer to a rear of the rotation direction of the impeller than the first vanes is a second gap; and the first gap is smaller than the second gap.

4. The centrifugal fan in accordance with claim 3, wherein the first gap is half of the second gap or more.

5. The centrifugal fan in accordance with claim 1, wherein inclined portions are at axial inner ends of the vanes;

the inclined portions are inclined such that the inclined portions are closer to an axially outer side as the inclined portions extend to another axial side.

6. The centrifugal fan in accordance with claim 5, wherein the inclined portions include first inclined portions and second inclined portions;

the first inclined portions are at ends at another axial side of the first vanes; and the second inclined portions are at ends at another axial side of the second vanes.

7. The centrifugal fan in accordance with claim 6, wherein a bulged portion protruding towards another axial side is at the center of the base; and axial inner ends of the first inclined portions are closer to one axial side than the bulged portion.

8. The centrifugal fan in accordance with claim 6, wherein a bulged portion protruding towards another axial side is at the center of the base; and axial inner ends of the second inclined portions are closer to the other axial side than the bulged portion.

9. The centrifugal fan in accordance with claim 1, wherein a circumferential thickness of radially outer ends of the vanes decreases from one axial side to another axial side.

10. The centrifugal fan in accordance with claim 1, further comprising an impeller which includes a motor.

11. The centrifugal fan in accordance with claim 1, further comprising an impeller which is an impeller of a fan included in a refrigerator.

* * * * *